US008677610B2

(12) United States Patent
Liu

(10) Patent No.: US 8,677,610 B2
(45) Date of Patent: Mar. 25, 2014

(54) CRIMPING TOOL

(75) Inventor: Jen Kai Liu, New Taipei (TW)

(73) Assignee: Jetool Corp., New Taipei (TW)

( * ) Notice: Subject to any disclaimer, the term of this patent is extended or adjusted under 35 U.S.C. 154(b) by 221 days.

(21) Appl. No.: 13/424,385

(22) Filed: Mar. 20, 2012

(65) Prior Publication Data

US 2013/0247365 A1 Sep. 26, 2013

(51) Int. Cl.
*H01R 43/042* (2006.01)

(52) U.S. Cl.
USPC ..... 29/751

(58) Field of Classification Search
CPC ..... H01R 43/042; H01R 43/0425
USPC ..... 29/751, 750, 752, 753, 754, 758
See application file for complete search history.

(56) References Cited

U.S. PATENT DOCUMENTS

| | | | | |
|---|---|---|---|---|
| 2,713,279 | A * | 7/1955 | Harris | 72/31.12 |
| 7,627,944 | B2 * | 12/2009 | Holliday | 29/751 |
| 2008/0263859 | A1 * | 10/2008 | Wang et al. | 29/751 |
| 2011/0154651 | A1 * | 6/2011 | Liu | 29/750 |

* cited by examiner

*Primary Examiner* — Livius R Cazan

(57) ABSTRACT

A crimping tool is provided. The crimping tool can crimp coaxial cables of various specifications via the rotation of a rotatable placement seat and/or the adjustment of the depth of a screw rod which is screwed in a screw hole. Further, a holding region is formed at the crimping tool by moving a first holding block and a second holding block towards each other. During an operation, the coaxial cable is wrapped around the holding region. Therefore, the coaxial cable will not move excessively during a crimping operation, resulting in an increase of quality of the crimped coaxial cable.

16 Claims, 15 Drawing Sheets

CRIMPING TOOL

BACKGROUND OF THE INVENTION

1. Field of the Invention

The invention relates to crimping tools and more particularly to a crimping tool of the type that can crimp coaxial tips that are of various specifications and coaxial cables that are of various specifications.

2. Description of Related Art

A coaxial cable is an electrical cable which has two separate conductors that share a common center axis. Coaxial cables are commonly found in such applications as undersea cable, underground cable, cable TV systems, and etc. Due to the wide range of applications with coaxial cable, securely crimping a coaxial connector and a coaxial cable has become an important topic.

A hand tool and its crimp piece is found in a prior art document which can achieve the goal of crimping together a coaxial connector and a coaxial cable, upon further study, the prior art had the following disadvantages:

When working with coaxial connector of various specifications, it is required to pull out and rotate follow by re-inserting the assembly for adjustment. This operating mode is extremely inconvenient. Inability to adjust the length of crimp head which is exposed externally; therefore, the hand tool is unable to crimp coaxial connector and coaxial cable of different specifications. The coaxial cable moves during crimping operation; hence, the quality of the crimp between the coaxial connector and the coaxial cable is affected.

Notwithstanding the prior art, the invention is neither taught nor rendered obvious thereby.

SUMMARY OF THE INVENTION

It is therefore one object of the invention to provide a crimping tool comprising a first crimp handle, a second crimp handle, a crimp handle recovering elastic component, and a rotatable placement seat. Wherein the first crimp handle includes: a guide hole and a through hole. The guide hole is installed at the first crimp handle, while the through hole is installed next to the guide hole. The through hole passes through the first crimp handle. Furthermore, a placement seat positioning slot is installed next to the through hole. In addition, there is a placement seat recovering elastic component installed inside the placement seat positioning slot. A placement seat positioning body is installed on the placement seat recovering elastic component. The second crimp handle includes a movable link and a push rod. The second crimp handle connects to the first crimp handle via a pivot. Furthermore, the second crimp handle connects to the movable link via a pivot, and is connected to the push rod via a pivot. The push rod inserts into the guide hole. One end of the crimp handle recovering elastic component is installed inside the first crimp handle, while the other end of the crimp handle recovering elastic component is installed inside the second crimp handle.

The rotatable placement seat includes a placement seat protrusion. The orthographic projected area of the rotatable placement seat is larger than the orthographic projected area of the through hole.

Multiple placement slots having various specifications are installed at one end of the rotatable placement seat. Multiple positioning holes are installed at the other end of the rotatable placement seat. The placement seat protrusion is installed next to those positioning holes. When the placement seat protrusion is placed within the through hole, and the placement seat positioning body lodges into one of the multiple positioning holes.

In addition, the push rod includes screw hole and a crimp mould. A crimp head is installed at one end of the crimp mould, while a screw rod is installed at the other end of the crimp head. The crimp head has a flat surface. A convex body is installed at the flat surface; moreover, a depression is disposed at the convex body. There is a screw hole disposed at the push rod so the screw rod can screw into the screw hole.

A rotatable placement seat includes a first holding block and a second holding block. The first holding block is pivot at the rotatable placement seat. The second holding block is pivot at the rotatable placement seat. Furthermore, it is situated next to the first holding block. Through the rotation of the first and second holding blocks, both the first and second holding blocks approach closer to each other and form a holding region.

An aspect of the invention is to offer a crimping tool which crimps coaxial cables of different specifications via an anchor point whereby rotating the aforementioned rotatable placement seat to a predefined placement slot.

Another aspect of the invention is to offer a crimping tool which allows for rotation of the screw rod at the crimp mould to be driven by the rotation of the crimp mould; therefore, provides adjustment to the depth of the screw rod inside the screw hole. The net result is the length adjustment of the crimp head of the crimp mould that exposes outside the screw hole; hence, different coaxial connector of various specifications can be crimped.

Still another object of the invention is to offer a crimping tool. The crimping tool forms a holding region by moving the first holding block and the second holding block towards each other. The holding region wraps around a coaxial cable. Therefore, the coaxial cable will not move excessively during crimping operation, resulting in increased crimp quality of the coaxial cable. The crimp modes of the coaxial cable and the coaxial connector are as follows:

Place the un-crimped coaxial connector and coaxial cable into the crimping tool as shown in FIGS. 10-12, an F-type coaxial connector and a RG11 coaxial cable. Next, press and close the first crimp handle and the second crimp handle as shown in FIGS. 26 and 27. The coaxial connector and the coaxial cable are now crimped as shown in FIG. 13, the crimped F-type coaxial connector and RG11 coaxial cable.

Place the un-crimped coaxial connector and coaxial cable into the crimping tool as shown in FIGS. 14-16 to form a BNC-type coaxial connector and a coaxial cable. Next, press and close the first crimp handle and the second crimp handle as shown in FIGS. 26-27. The coaxial connector and the coaxial cable are now crimped as shown in FIG. 17 to form the crimped BNC-type coaxial connector and coaxial cable.

Place the un-crimped coaxial connector and coaxial cable into the crimping tool as shown in FIGS. 18-20, a F-type coaxial connector and a coaxial cable. Next, press and close the first crimp handle and the second crimp handle as shown in FIGS. 26-27. The coaxial connector and the coaxial cable are now crimped as shown in FIG. 17, the crimped BNC type coaxial connector and coaxial cable.

Place the un-crimped coaxial connector and coaxial cable into the crimping tool as shown in FIGS. 22-24 to form a RCA-type coaxial connector and a coaxial cable. Next, press and close the first crimp handle and the second crimp handle as shown in FIGS. 26 and 27. The coaxial connector and the coaxial cable are now crimped as shown in FIG. 25 to form the crimped RCA-type coaxial connector and coaxial cable.

The F-type connector and RG11 coaxial cable, the BNC-type connector and coaxial cable, and the RCA-type connector and coaxial cable are for reference only. Therefore, the actual operation of the invention is not limited by the aforementioned crimp modes.

The above and other objects, features and advantages of the invention will become apparent from the following detailed description taken with the accompanying drawings.

DETAILED DESCRIPTION OF THE INVENTION

Figure 1:
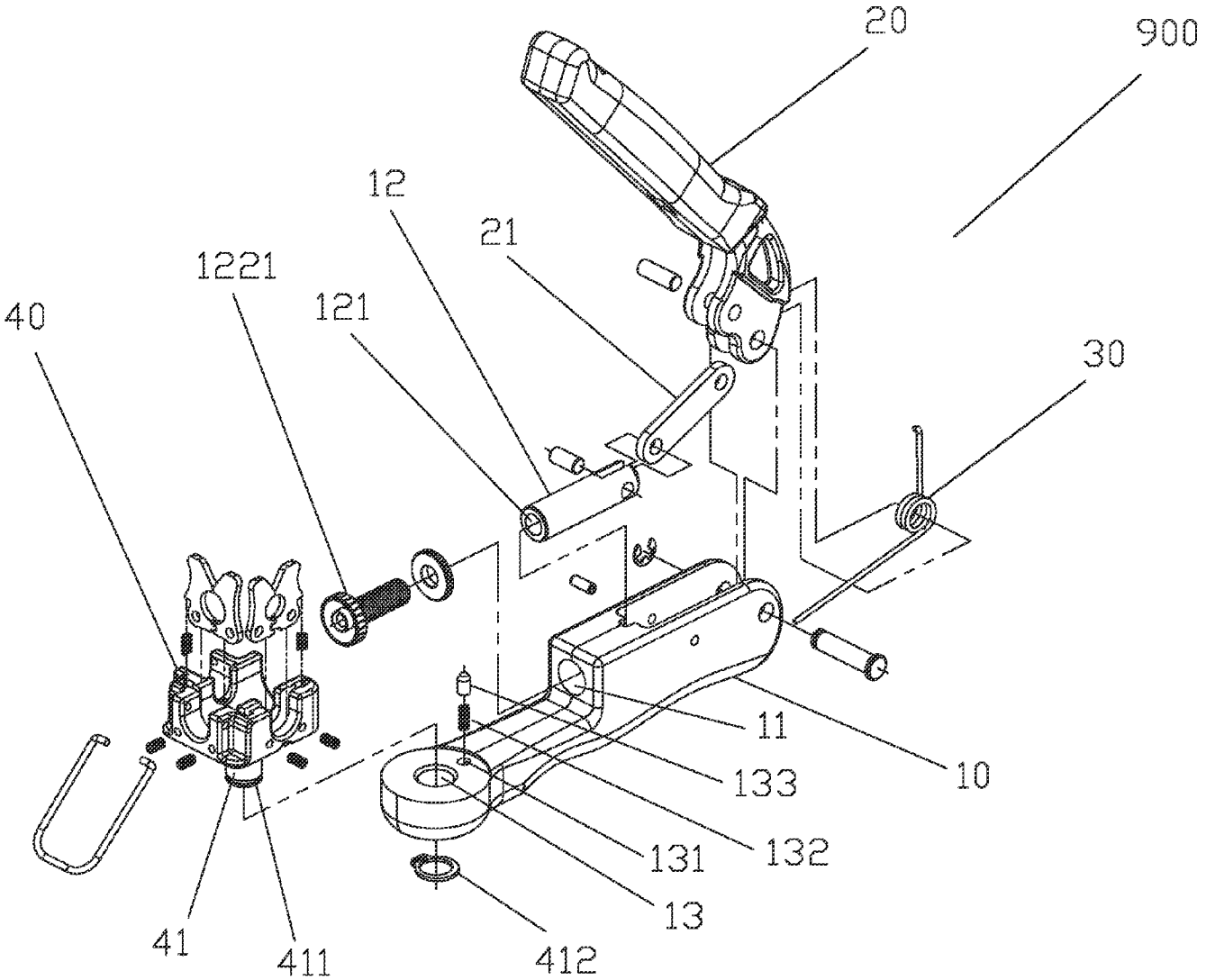
FIG. 1 is an exploded view of the crimping tool of the invention.
Figure 2:
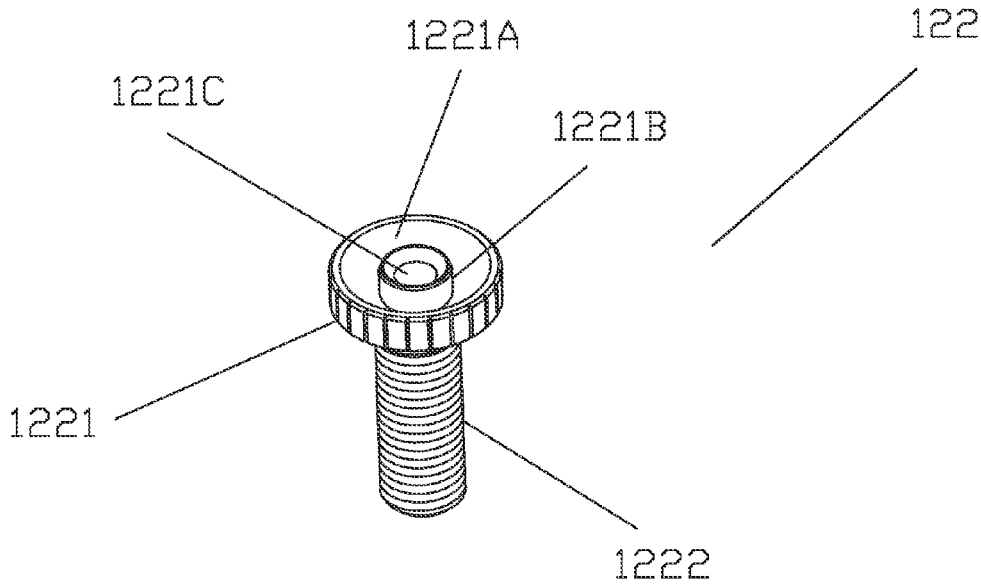
FIG. 2 is the crimp mould of the crimping tool.
Figure 3:
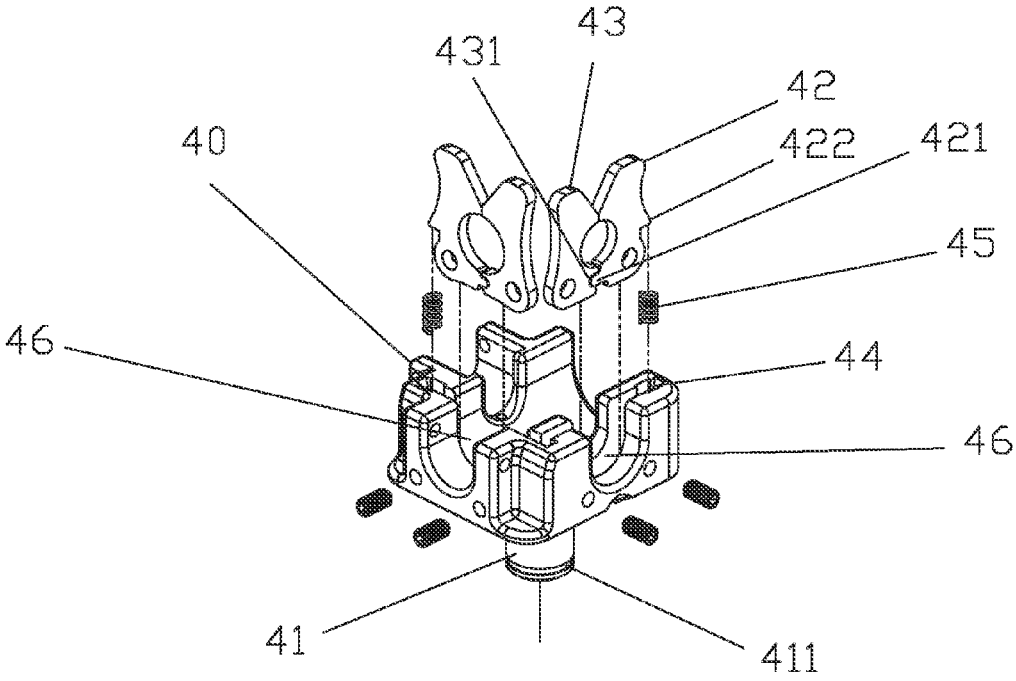
FIG. 3 is the rotatable placement seat of the crimping tool.
Figure 4:
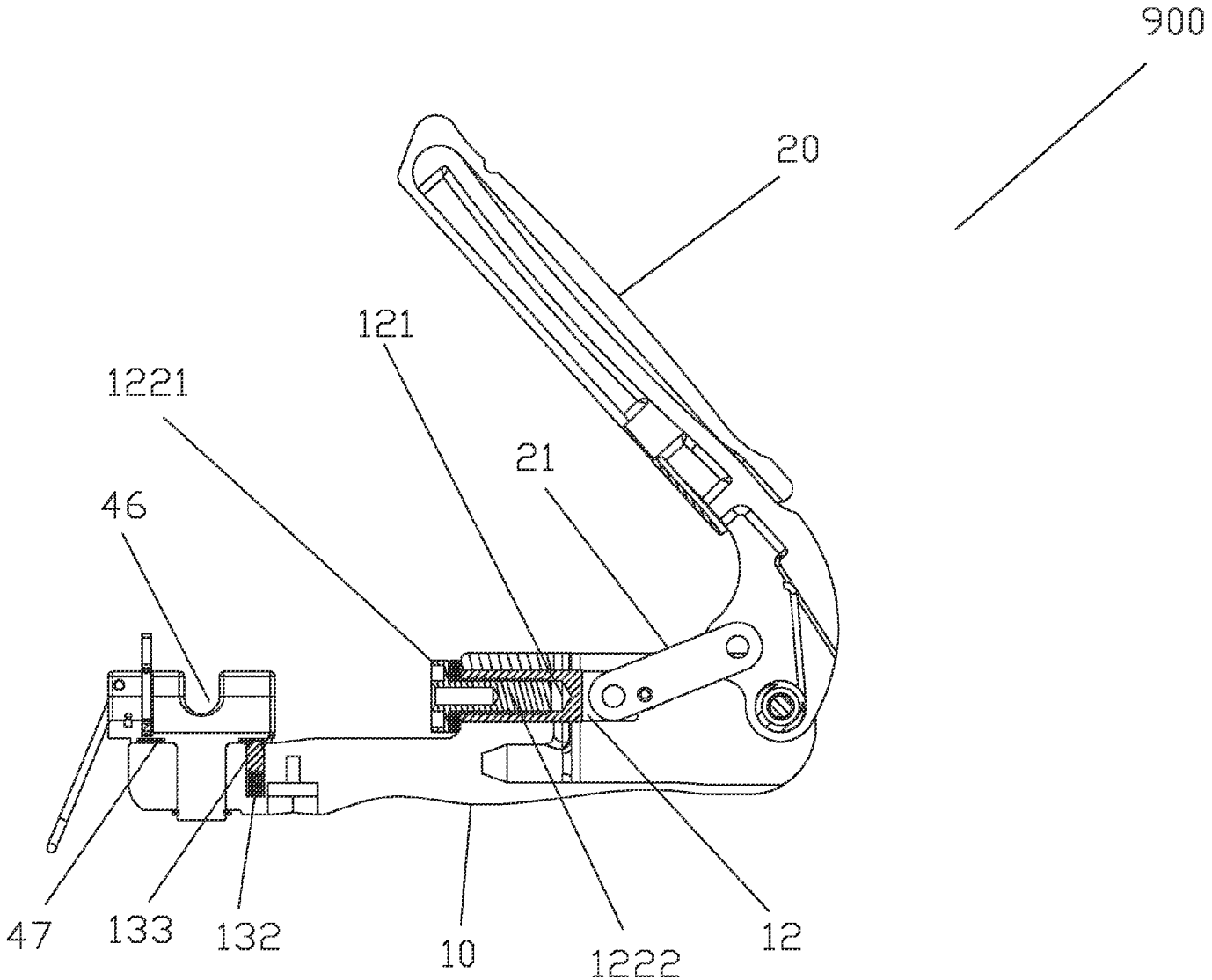
FIG. 4 is a cutaway view of the crimping tool.
Figure 5:
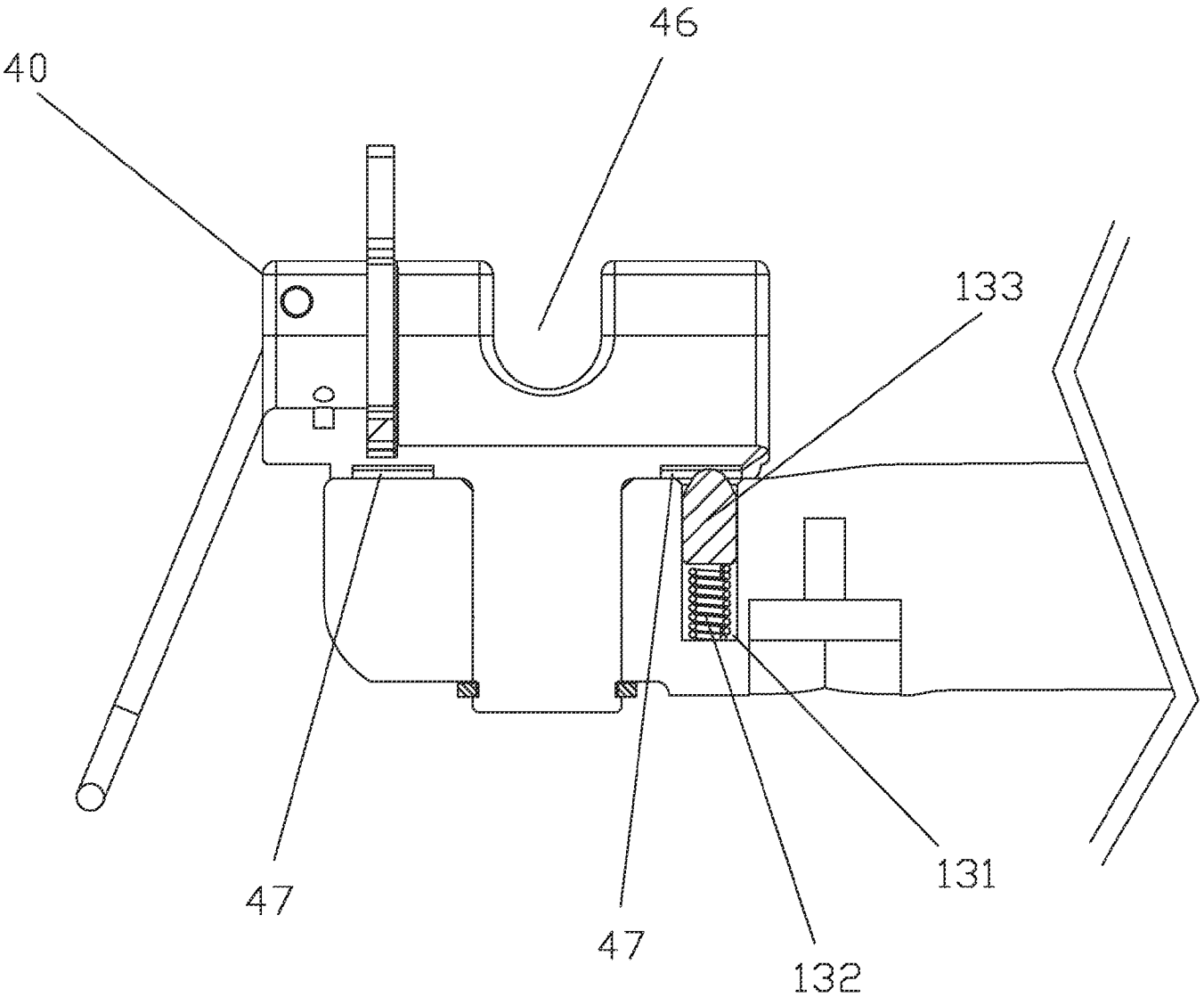
FIG. 5 is an enlarged view of the rotatable placement seat of the crimping tool.
Figure 6:
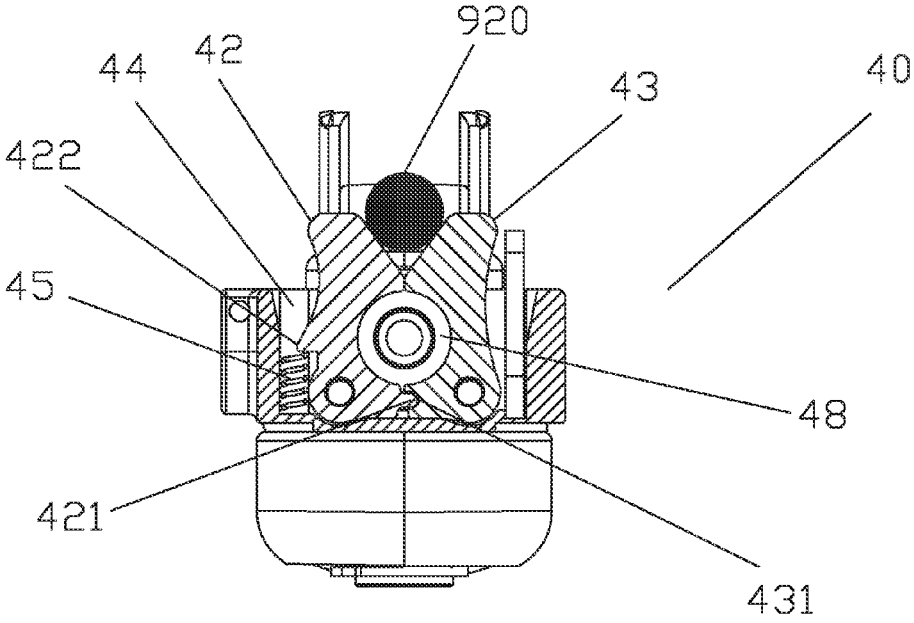
FIG. 6 shows the first holding block and the second holding block before they are spread opened.
Figure 7:
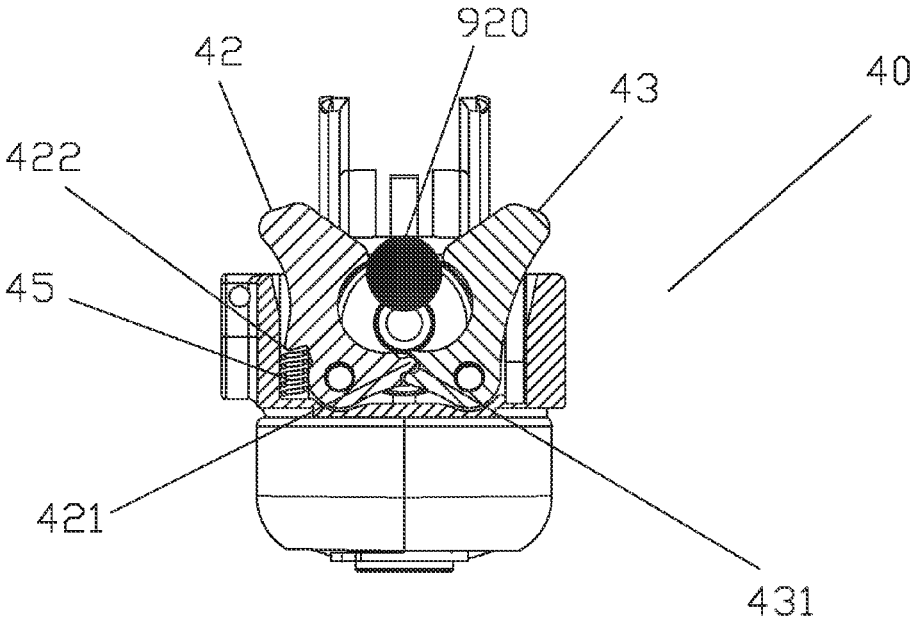
FIG. 7 shows the first holding block and the second holding block after they are spread opened.
Figure 8:
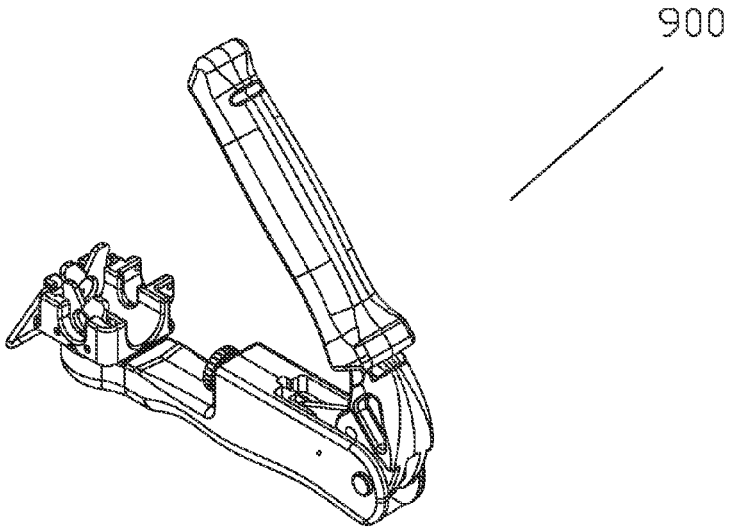
FIG. 8 shows the rotatable placement seat of the crimping tool and the rotatable placement seat before it is rotated.
Figure 9:
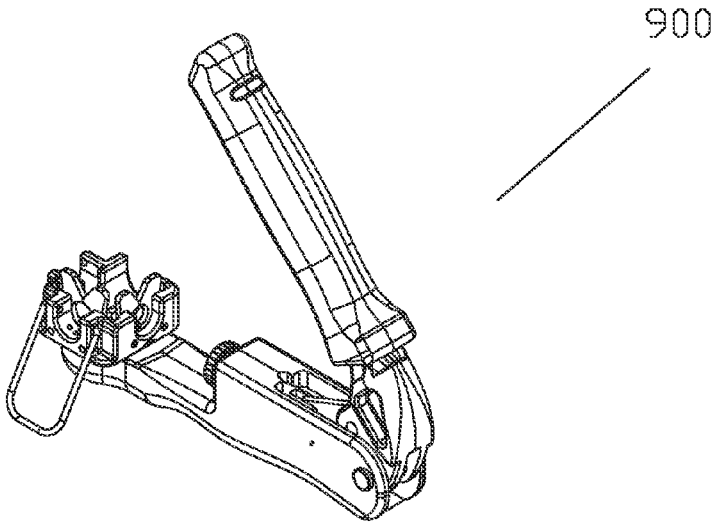
FIG. 9 shows the rotatable placement seat of the crimping tool and the rotatable placement seat after it has been rotated.
Figure 10:
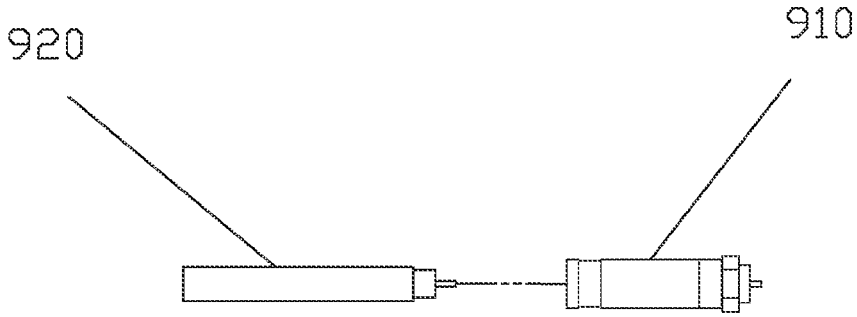
FIG. 10 shows F-type coaxial connector and RG11 coaxial cable before they are crimped.
Figure 11:
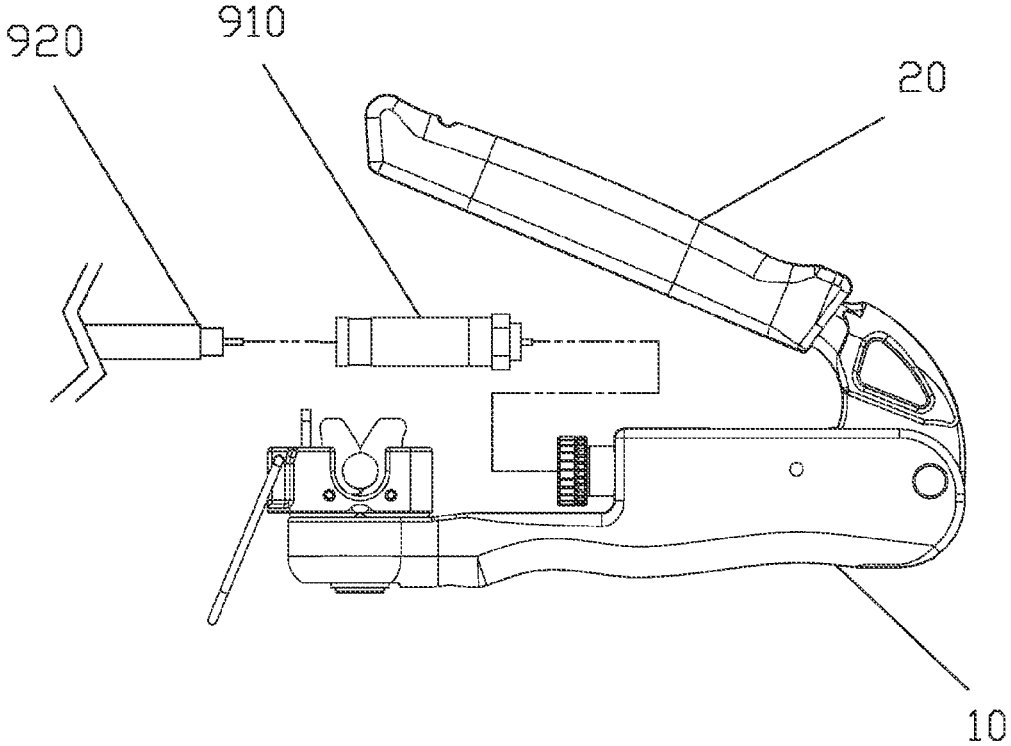
FIG. 11 is an exploded view of the F-type coaxial connector and RG11 coaxial being placed inside the crimping tool.
Figure 12:
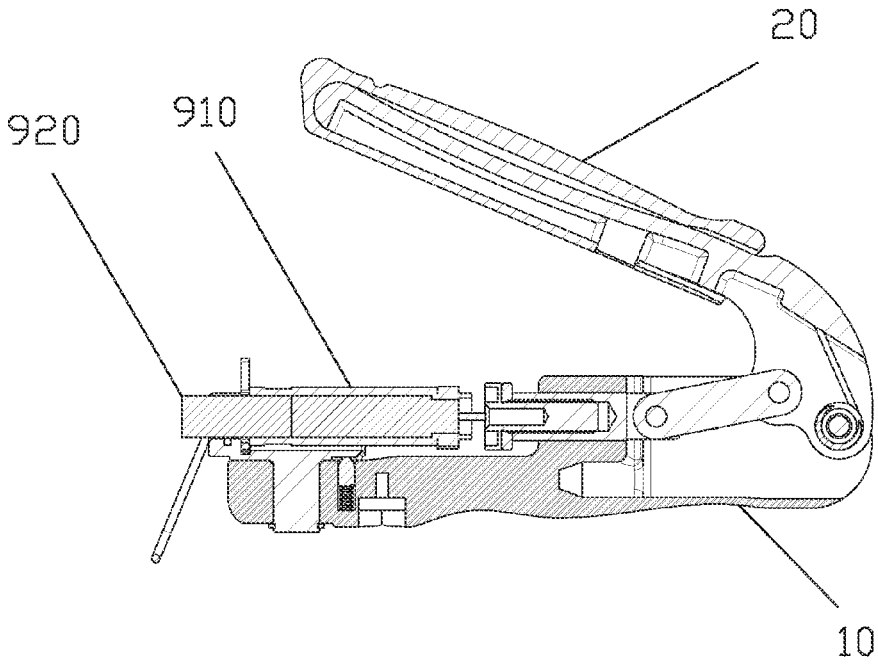
FIG. 12 is a cutaway view of the F-type coaxial connector and the RG11 cable while they are placed inside the crimping tool.
Figure 13:
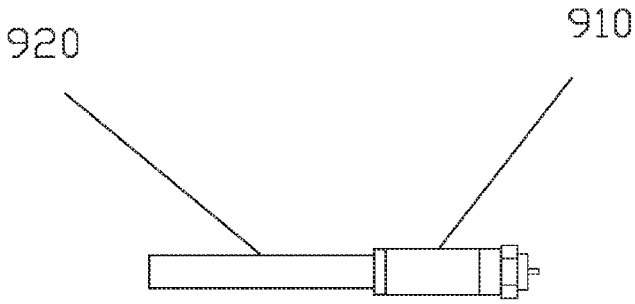
FIG. 13 shows the F-type coaxial connector and the RG11 coaxial cable crimped together.
Figure 14:
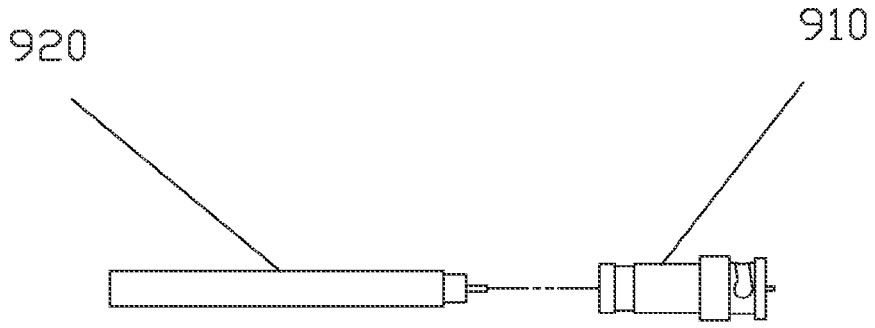
FIG. 14 shows BNC-type coaxial connector and coaxial cable before they are crimped.
Figure 15:
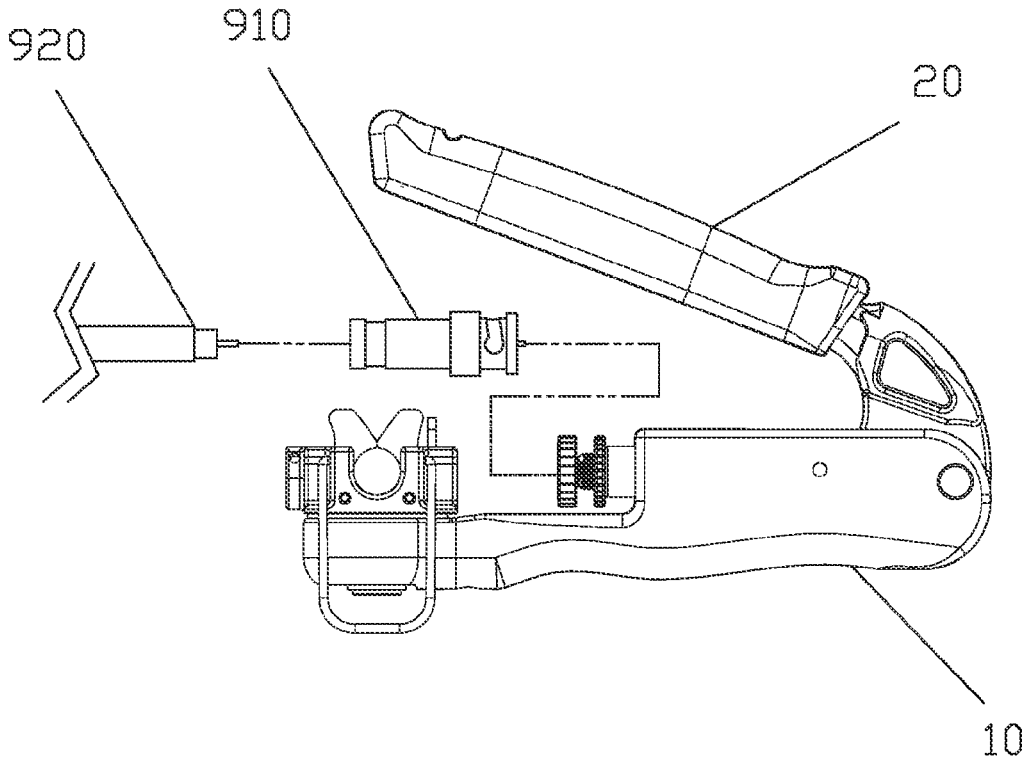
FIG. 15 is an exploded view of the BNC-type coaxial connector and the coaxial cable being placed inside the crimping tool.
Figure 16:
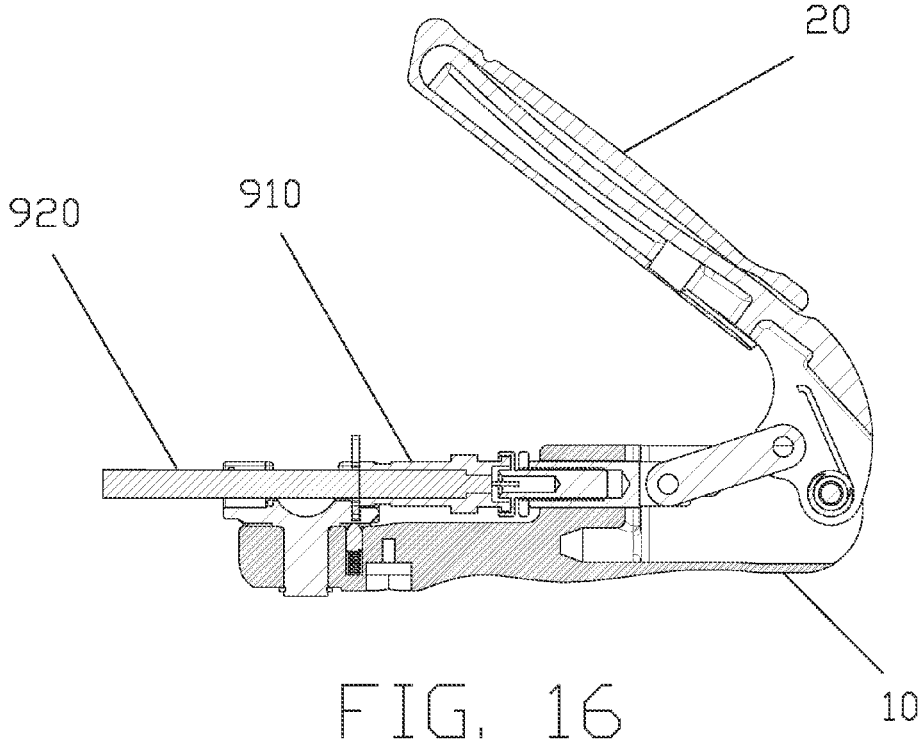
FIG. 16 is a cutaway view of the BNC-type coaxial connector and the coaxial cable while they are placed inside the crimping tool.
Figure 17:
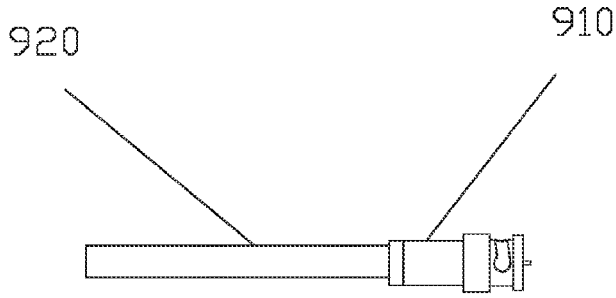
FIG. 17 shows the BNC-type coaxial connector and the coaxial cable crimped together.
Figure 18:
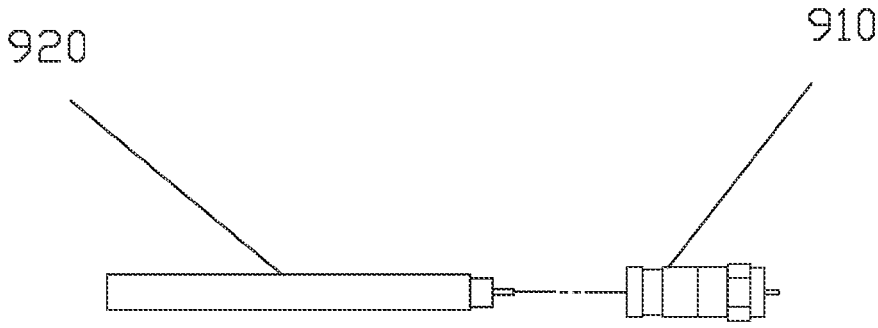
FIG. 18 shows F-type coaxial connector and coaxial cable before they are crimped.
Figure 19:
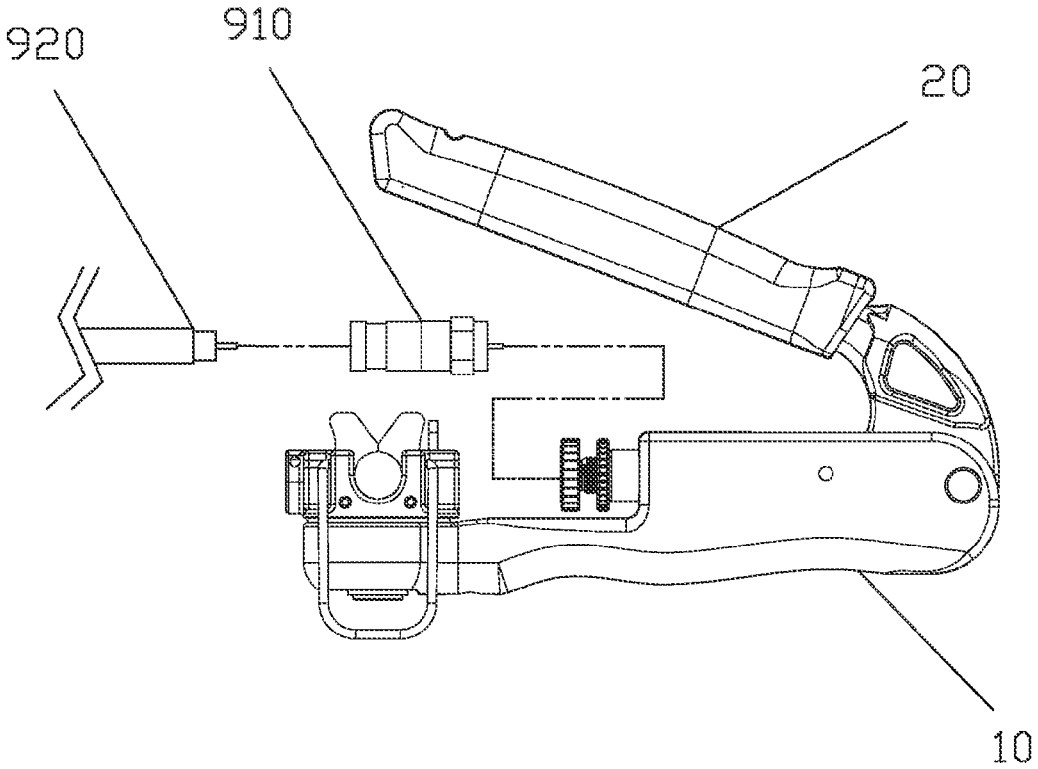
FIG. 19 is an exploded view of the F-type coaxial connector and the coaxial cable being placed inside the crimping tool.
Figure 20:
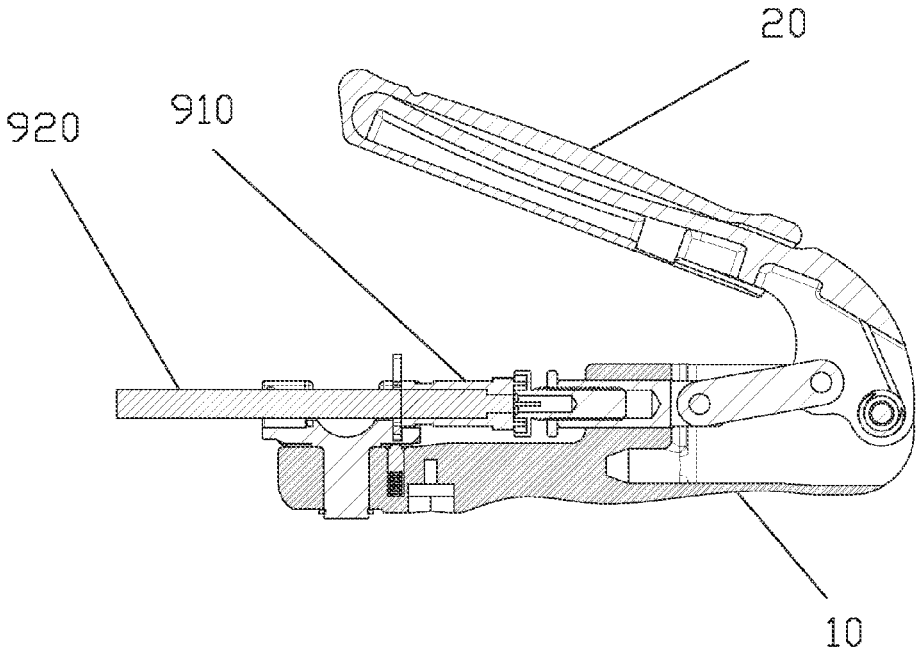
FIG. 20 is a cutaway view of the F-type coaxial connector and the coaxial cable while they are placed inside the crimping tool.
Figure 21:
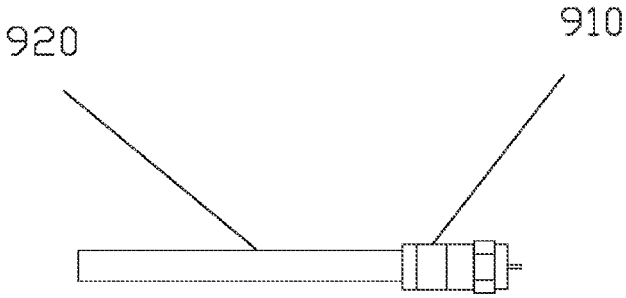
FIG. 21 shows the F-type coaxial connector and the coaxial cable crimped together.
Figure 22:
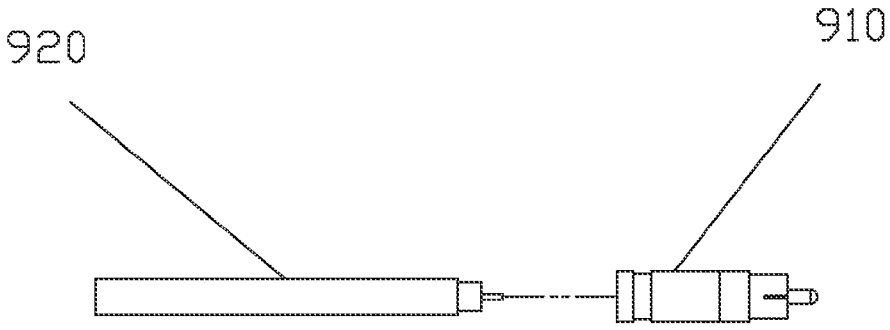
FIG. 22 shows RCA-type coaxial connector and coaxial cable before they are crimped.
Figure 23:
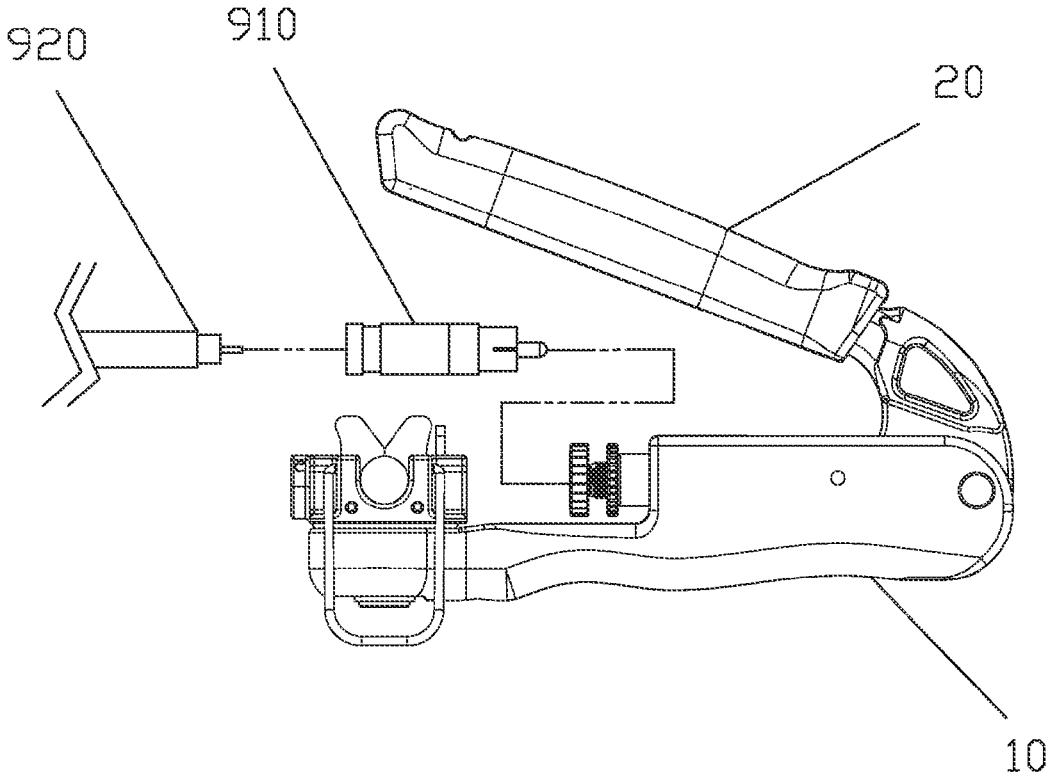
FIG. 23 is an exploded view of the RCA-type coaxial connector and the coaxial cable being placed inside the crimping tool.
Figure 24:
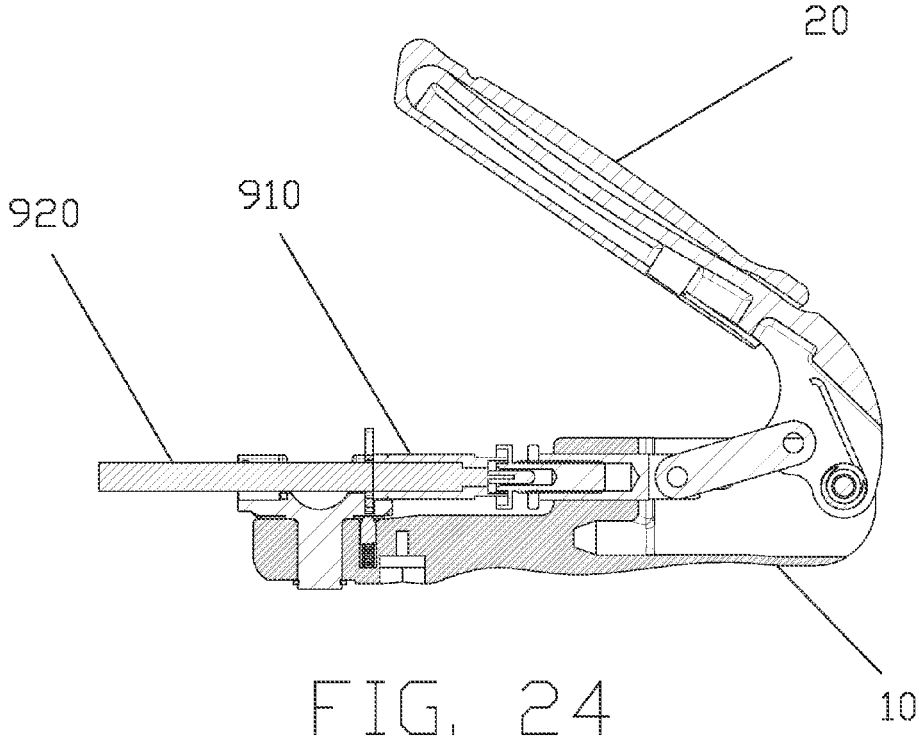
FIG. 24 is a cutaway view of the RCA-type coaxial connector and the coaxial cable while they are placed inside the crimping tool.
Figure 25:
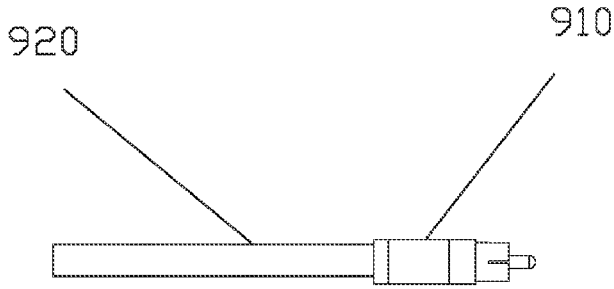
FIG. 25 shows the RCA-type coaxial connector and the coaxial cable crimped together.
Figure 26:
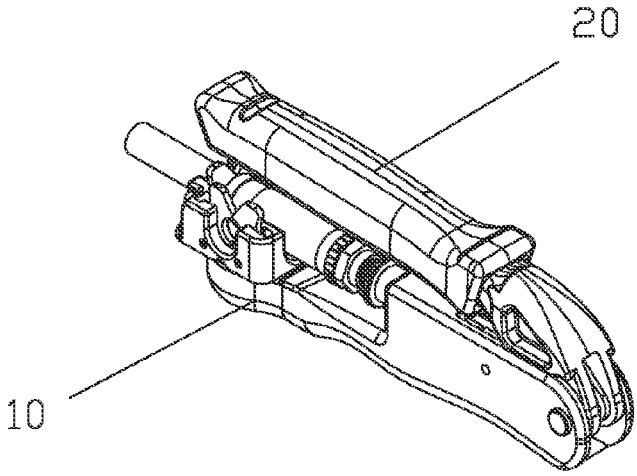
FIG. 26 shows the crimping tool having the first crimp handle and the second crimp handle closed together.
Figure 27:
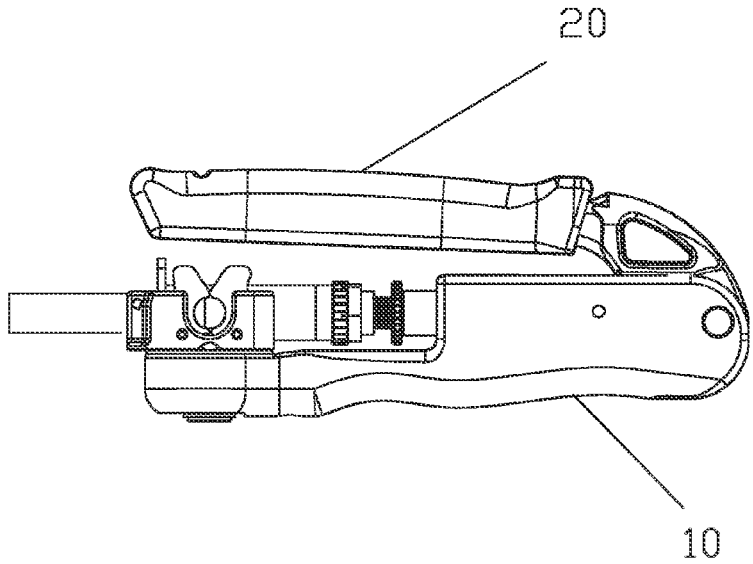
FIG. 27 is a cutaway view of the crimping tool having the first crimp handle and the second crimp handle closed together.

Referring to FIGS. 1 to 27, a crimping tool 900 in accordance with the invention is shown. The crimping tool 900 is utilized to crimp the coaxial connector 910 and the coaxial cable 920. The crimping tool 900 includes a first crimp handle 10, a second crimp handle 20, a crimp handle recovering elastic component 30, and a rotatable placement seat 40.

The first crimp handle 10 includes a guide hole 11 and a through hole 13. The guide hole 11 is installed at the first crimp handle 10, while the through hole 13 is installed next to the guide hole 11. The through hole 13 passes through the first crimp handle 10. Furthermore, a placement seat positioning slot 131 is installed next to the through hole 13. In addition, there is a placement seat recovering elastic component 132 installed inside the placement seat positioning slot 131. A placement seat positioning body 133 is installed on the placement seat recovering elastic component 132.

The second crimp handle 20 includes a movable link 21 and a push rod 12. The second crimp handle 20 connects to the first crimp handle 10 via a pivot. Furthermore, the second crimp handle 20 connects to the movable link 21 via a pivot, and the second crimp handle 20 is also connected to the push rod 12 via a pivot. The push rod 12 inserts into the guide hole 11. One end of the crimp handle recovering elastic component 30 is installed inside the first crimp handle 10, while the other end of the crimp handle recovering elastic component 30 is installed inside the second crimp handle 20. Therefore, when pressure is applied at the second crimp handle 20, a downward pressure will compress the crimp handle recovering elastic component 30. The angle between the first crimp handle 10 and the second crimp handle 20 will become smaller. The second crimp handle 20 will apply force to the movable link 21 which will push the push rod 12 to pass through the guide hole 11 and push the push rod 12 to move forward. Subsequently, when force is removed from the second crimp handle 20, the crimp handle recovering elastic component 30 will push the first crimp handle 10 and the second crimp handle 20 back to their original positions.

The rotatable placement seat 40 includes a placement seat protrusion 41. The orthographic projected area of the rotatable placement seat 40 is larger than the orthographic projected area of the through hole 13. Therefore, the rotatable placement seat 40 will not fall out of the through hole 13. Multiple placement slot 46 having various specifications are installed at one end of the rotatable placement seat 40. Multiple positioning hole 47 are installed at the other end of the rotatable placement seat 40. The placement seat protrusion 41 is installed next to those positioning hole 47. When the placement seat protrusion 41 is placed inside the through hole 13, the placement seat positioning body 133 lodges into one of the multiple positioning hole 47. Therefore, when the rotatable placement seat 40 rotates, the placement seat positioning body 133 will lodge into different positioning hole 47 and achieve the goal of having the rotatable placement seat 40 to rotate and position inside the through hole 13.

Furthermore, the placement seat protrusion 41 has a ring shaped slot 411. When the placement seat protrusion 41 is placed with the through hole 13, the ring shaped slot 411 is situated at the outside of the through hole 13 and is lodged by a lodge ring 412. The orthographic projection area of the ring shaped slot 411 after it is lodged by the lodge ring 412 is larger than the orthographic projection area of the through hole 13.

Since the orthographic projection area of the placement seat protrusion 41 is greater than the orthographic projection area of the through hole 13 and the placement seat protrusion 41 is lodged by the lodge ring 412, the placement seat protrusion 41 will not fall through neither end of the through hole 13.

Furthermore, the push rod 12 includes screw hole 121 and a crimp mould 122. A crimp head 1221 is installed at one end of the crimp mould 122, while a screw rod 1222 is installed at the other end of the crimp head 1221. The crimp head 1221 has a flat surface 1221A. A convex body 1221B is installed at the flat surface 1221A; moreover, a depression 1221C is disposed at the convex body 1221B. There is a screw hole 121 disposed at the push rod 12 so the screw rod 1222 can screw into the screw hole 121. Therefore, crimping coaxial connectors of various specifications is made possible by disposing crimp mould 122 via the push rod 12. Furthermore, the screw rod 1222 on the crimp mould 122 is rotated via the rotation of crimp mould 122. Therefore, adjusting the depth of screw rod 1222 being screwed into the screw hole 121 changes the length of the crimp head 1221 of the crimp mould 122 that exposes outside the screw hole 121. As a result, the crimping tool crimps coaxial connectors and coaxial cables of various specifications.

Furthermore, a rotatable placement seat 40 includes a first holding block 42 and a second holding block 43. The first holding block 42 is pivot at the rotatable placement seat 40. The second holding block 43 is pivot at the rotatable placement seat 40. Furthermore, it is situated next to the first holding block 42. Through the rotation of the first holding block 42 and second holding block 43, both first holding block 42 and second holding block 43 approach closer to each other and form a holding region 48. Since the coaxial cable 920 is wrapped around by the holding region 48, the coaxial cable 920 will not move excessively during operation with the use of the crimping tool 900. Hence, the crimp quality of the coaxial cable 920 is increased.

Furthermore, a protruding block 421 is disposed at the first holding block 42. A notch 431 is disposed at the second holding block 43. Moreover, protruding block 421 is placed within the notch 431. Through the rotation of the first holding block 42, the first holding block 42 leads the protruding block 421 to rotate, which in turns leads the notch 431 to rotate, which in turns leads the second holding block 43 to rotate.

Moreover, rotating the second holding block 43 leads the protruding block 421 to rotate. The rotation of the protruding block 421 leads the protruding block 421 to rotate, which in turns leads to the rotation of first holding block 42. Therefore, it is sufficient to only rotate the first holding block 42 to lead the second holding block 43 to rotate. In other words, the new and simplified operating mode only requires one hand to complete the crimp operation.

Furthermore, a clamp recovering slot 44 is disposed within a rotatable placement seat 40; in addition, a clamp recovering elastic component 45 is disposed within the clamp recovering slot 44. A clamp recovering block 422 is disposed at the first holding block 42; moreover, the clamp recovering block 422 supplies force against the clamp recovering elastic component 45. Therefore, after force is applied to rotate the first holding block 42, the clamp recovering elastic component 45 receives downward pressure.

Subsequently, when force is removed, the clamp recovering elastic component 45 will restore to its original position which will push the first holding block 42 to rotate gradually, which further leads the second holding block 43 to rotate. Therefore, a user can simply complete the operation using only a single hand and apply force to allow the first holding block 42 and the second holding block 43 to spread wide, place in the coaxial cable 920, follow by removing applied force in forming a holding region 48 by allowing the first holding block 42 and the second holding block 43 to approach closer to each other.

A first exemplary example of the crimping tool implementation is detailed below.

Rotate the rotatable placement seat 46 until it arrives at the positioning point of the placement slot according to a pre-defined specification. Place a coaxial connector 910 and a coaxial cable 920 at the placement seat 46. After applying pressure at the second crimp handle 20, the applied pressure will act downward onto the crimp handle recovering elastic component 30. Consequently, the angle between the first crimp handle 10 and the second crimp handle 20 will become smaller. The second crimp handle 20 forces the movable link which pushes the push rod 12 to pass into the guide hole 11. As a result, the push rod 12 is pushed forward to crimp the coaxial connector 910 and the coaxial cable 920 securely together.

A second exemplary example of the crimping tool implementation is detailed below.

Rotate the crimp mould 122 which in turns rotates the screw rod 1222 of the crimp mould 122. The rotation causes the depth adjustment of the screw rod 1222 while inside the screw hole 121; hence, the length of the crimp head 1221 of the crimp mould 122 that is exposed outside the screw hole 121 can be adjusted. Rotate the rotatable placement seat until it arrives at the positioning point of the placement slot 46 according to a pre-defined specification. Place the coaxial connector 910 and the coaxial cable 920 at the placement slot 46. After applying pressure at the second crimp handle 20, the applied pressure will act downward onto the crimp handle recovering elastic component 30. Consequently, the angle between the first crimp handle 10 and the second crimp handle 20 will become smaller. The second crimp handle 20 forces the movable link which pushes the push rod 12 to pass into the guide hole 11. As a result, the push rod 12 is pushed forward to crimp the coaxial connector 910 and the coaxial cable 920 securely together.

While the invention has been described in terms of preferred embodiments, those skilled in the art will recognize that the invention can be practiced with modifications within the spirit and scope of the appended claims.

What is claimed is:

1. A crimping tool comprising:

a first crimp handle;

a second crimp handle;

a crimp handle recovering elastic member; and a rotatable placement seat;

wherein the first crimp handle comprises a guide hole and a through hole;

wherein the guide hole is disposed at the first crimp handle, the through hole is disposed adjacent to the guide hole, the through hole passes through the first crimp handle, a placement seat positioning slot is disposed adjacent to the through hole, a placement seat recovering elastic member is disposed within the placement seat positioning slot, and a placement seat positioning body is disposed on the placement seat recovering elastic member;

wherein the second crimp handle comprises a movable link and a push rod;

wherein the second crimp handle connects to the first crimp handle pivotally, the second crimp handle connects to the movable link pivotally, the second crimp handle is connected to the push rod pivotally, the push rod inserts into the guide hole, one end of the crimp handle recovering elastic member is disposed within the first crimp handle, and the other end of the crimp handle recovering elastic member is disposed within the second crimp handle;

wherein the rotatable placement seat comprises a placement seat protrusion; and wherein the orthographic projected area of the rotatable placement seat is larger than the orthographic projected area of the through hole, multiple placement slots having various specifications are disposed at one end of the rotatable placement seat, multiple positioning holes are disposed at the other end of the rotatable placement seat, the placement seat protrusion is disposed adjacent to the positioning holes, and when the placement seat protrusion is placed within the through hole, the placement seat positioning body lodges into one of the multiple positioning holes.

2. The crimping tool of claim 1, wherein the push rod comprises a screw hole, a crimp mould, a crimp head disposed at one end of the crimp mould, and a screw rod disposed at the other end of the crimp head, the crimp head having a flat surface, a convex body disposed at the flat surface, and a depression disposed at the convex body, and wherein the screw hole is disposed at the push rod so that the screw rod screws into the screw hole.

3. The crimping tool of claim 2, wherein the rotatable placement seat comprises a first holding block and a second holding block, wherein the first holding block pivots at the rotatable placement seat, wherein the second holding block pivots at the rotatable placement seat, and the second holding block is situated adjacent to the first holding block; whereby, through the rotation of the first and second holding blocks, both the first and second holding blocks approach close to each other and form a holding region.

4. The crimping tool of claim 3, wherein a protruding block is disposed at the first holding block, and wherein a notch is disposed at the second holding block within which the protruding block is placed.

5. The crimping tool of claim 4, further comprising a clamp recovering slot disposed within the rotatable placement seat, a clamp recovering elastic member disposed within the clamp recovering slot, and a clamp recovering block disposed at the first holding block, and wherein the clamp recovering block exerts a downward force on the clamp recovering elastic member.

6. The crimping tool of claim 1, wherein the placement seat protrusion has a ring shaped slot, wherein when the placement seat protrusion is placed inside the through hole, the ring shaped slot is situated at the outside of the through hole and is lodged by a lodge ring, and wherein the orthographic projection area of the ring shaped slot after it is lodged by the lodge ring is larger than the orthographic projection area of the through hole.

7. The crimping tool of claim 6, wherein the push rod comprises a screw hole, a crimp mould, a crimp head disposed at one end of the crimp mould, and a screw rod disposed at the other end of the crimp head, wherein the crimp head has a flat surface, a convex body disposed at the flat surface, and a depression disposed at the convex body, and wherein the screw hole is disposed at the push rod so that the screw rod screws into the screw hole.

8. The crimping tool of claim 7, wherein the rotatable placement seat comprises a first holding block and a second holding block, wherein the first holding block pivots at the rotatable placement seat, the second holding block pivots at the rotatable placement seat, and the second holding block is situated adjacent to the first holding block; whereby; through the rotation of the first and second holding blocks, both the first and second holding blocks approach close to each other and form a holding region.

9. The crimping tool of claim 8, wherein a protruding block is disposed at the first holding block, wherein a notch is disposed at the second holding block, and wherein the protruding block is placed inside the notch.

10. The crimping tool of claim 9, further comprising a clamp recovering slot disposed within the rotatable placement seat, a clamp recovering elastic member disposed within the clamp recovering slot, and a clamp recovering block disposed at the first holding block, wherein the clamp recovering block exerts a downward force on the clamp recovering elastic member.

11. The crimping tool of claim 6, wherein the rotatable placement seat comprises a first holding block and a second holding block, wherein the first holding block pivots at the rotatable placement seat, wherein the second holding block pivots at the rotatable placement seat, and wherein the second holding block is situated adjacent to the first holding block; whereby; through the rotation of the first and second holding blocks, both the first and second holding blocks approach close to each other and form a holding region.

12. The crimping tool of claim 11, wherein a protruding block is disposed at the first holding block, wherein a notch is disposed at the second holding block, and wherein the protruding block is placed inside the notch; whereby, through the rotation of the first holding block, the first holding block leads the protruding block to rotate, which in turns leads the notch to rotate, and which in turns leads the second holding block to rotate.

13. The crimping tool of claim 12, further comprising a clamp recovering slot disposed within the rotatable placement seat, a clamp recovering elastic member disposed within the clamp recovering slot, and a clamp recovering block disposed at the first holding block, wherein the clamp recovering block exerts a downward force on the clamp recovering elastic member.

14. The crimping tool of claim 1, wherein the rotatable placement seat comprises a first holding block and a second holding block, wherein the first holding block pivots at the rotatable placement seat, wherein the second holding block pivots at the rotatable placement seat, and wherein the second holding block is situated adjacent to the first holding block; whereby; through the rotation of the first and second holding blocks, both the first and second holding blocks approach close to each other and form a holding region.

15. The crimping tool of claim 14, wherein a protruding block is disposed at the first holding block, wherein a notch is disposed at the second holding block, and wherein the protruding block is placed inside the notch; whereby through the rotation of the first holding block, the first holding block leads the protruding block to rotate, which in turns leads the notch to rotate, and which in turns leads the second holding block to rotate.

16. The crimping tool of claim 15, further comprising a clamp recovering slot disposed within the rotatable placement seat, and a clamp recovering elastic member disposed within a clamp recovering slot; wherein the clamp recovering block is disposed at the first holding block; and wherein the clamp recovering block exerts a downward force on the clamp recovering elastic member.

* * * * *